US006206611B1

(12) United States Patent
Schreck

(10) Patent No.: US 6,206,611 B1
(45) Date of Patent: Mar. 27, 2001

(54) DEVICE FOR CLEANING THE TIRE OF A ROLLER

(75) Inventor: Martin Schreck, München (DE)

(73) Assignee: Wacker-Werke GmbH & Co. KG (DE)

( * ) Notice: Subject to any disclaimer, the term of this patent is extended or adjusted under 35 U.S.C. 154(b) by 0 days.

(21) Appl. No.: 09/242,752

(22) PCT Filed: Nov. 26, 1997

(86) PCT No.: PCT/EP97/06597

§ 371 Date: Feb. 19, 1999

§ 102(e) Date: Feb. 19, 1999

(87) PCT Pub. No.: WO98/28495

PCT Pub. Date: Jul. 2, 1998

(30) Foreign Application Priority Data

Dec. 21, 1996 (DE) ..... 296 22 280 U

(51) Int. Cl.[7] ..... G01C 19/26
(52) U.S. Cl. ..... 404/129; 180/20
(58) Field of Search ..... 404/128, 129, 404/103, 118; 180/20

(56) References Cited

U.S. PATENT DOCUMENTS

| | | | | |
|---|---|---|---|---|
| 1,509,684 | * | 9/1924 | Monroe | 404/129 |
| 1,722,907 | * | 7/1929 | Liddle | 404/129 |
| 3,085,484 | * | 4/1963 | McAdams | 404/129 |
| 3,675,546 | | 7/1972 | Smith | 94/50 |
| 3,802,339 | * | 4/1974 | Andresson et al. | 404/129 |
| 4,040,762 | * | 8/1977 | Nilsson | 404/129 |
| 4,378,052 | | 3/1983 | Anderson | 172/449 |
| 4,421,435 | | 12/1983 | Zemke et al. | 404/113 |
| 5,222,828 | * | 6/1993 | Magalski | 404/129 |
| 5,778,482 | * | 7/1998 | Sbrigato | 404/115 |

FOREIGN PATENT DOCUMENTS

| | | |
|---|---|---|
| WO 93/09296 | 5/1993 | (EP) . |
| 211079 | 2/1924 | (GB) . |

* cited by examiner

*Primary Examiner*—Eileen D. Lillis
*Assistant Examiner*—Raymond Addie
(74) *Attorney, Agent, or Firm*—Boyle, Fredrickson, Newholm, Stein & Gratz S.C.

(57) ABSTRACT

A device for removing dirt adhering to the tire (2) of a roller used for compacting soil and for spraying the tire (2) with water. The scraping unit (5, 6) and a nozzle system (10, 11, 12) are joined into one modular component and the scraper (6) forms a cavity (10) that is sealed off from a scraper support (5). A water supply pipe (11) leads into the cavity (10) from which nozzles (12) branch off through the wall of the scraper support (5).

11 Claims, 2 Drawing Sheets

DEVICE FOR CLEANING THE TIRE OF A ROLLER

BACKGROUND OF THE INVENTION

1. Field of the Invention

This application claims priority from PCT/EP97/06597, filed Nov. 26 1997.

The invention relates to a device for cleaning the tire of a soil tamping roller of adhering dirt and for spraying the tire with water, this device being provided in a known way with a stripping device which extends essentially perpendicularly to the direction of rotation of the tire over the tire region to be cleaned and which is fastened to a tire carrier in a fixed position in relation to the tire, with a nozzle arrangement which is fastened to the tire carrier in a fixed position in relation to the tire, and with nozzles, arranged at a distance from one another and approximately parallel to the stripping device, for spraying water onto the tire behind the stripper in the tire running direction.

2. Description of the Related Art

In the known devices of this type, the stripping device and the nozzle arrangement are provided as components which are separate from one another and which each have to be fastened independently to the tire carrier.

OBJECT AND SUMMARY OF THE INVENTION

The object of this invention is to provide a device for cleaning dirt and spraying a tire of a soil tamping rollers, which, as regards both its design and its mounting on the tire carrier, is improved, as compared with the known devices, in such a way that it requires a lower outlay in terms of manufacture and assembly.

According to the invention, the above object is achieved in that the stripping device and the nozzle arrangement are combined to form a structural unit and the latter is formed from a trough-like stripper holder, which extends continuously over the width of the tire region to the cleaned, and from a stripper, which is arranged in a stripper holder and which projects toward the tire from the stripper holder over the length of the latter, there being formed in the stripper a cavity which is sealed off relative to the stripper holder and extends over a substantial part of the length of the latter and into which a water inflow line opens and from which the nozzles branch off through the wall of the stripper holder.

The device according to the invention consists of only a few components which are each independently shaped in a simple way and which can easily be connected to one another to form the desired structural unit, and said device can also be mounted on a tire carrier in a very simple way because all its parts are combined to form a single structural unit.

BRIEF DESCRIPTION OF THE DRAWINGS

The invention is explained in more detail below by means of an exemplary embodiment with reference to the drawing in which.

DESCRIPTION OF THE PREFERRED EMBODIMENTS

Figure 1:
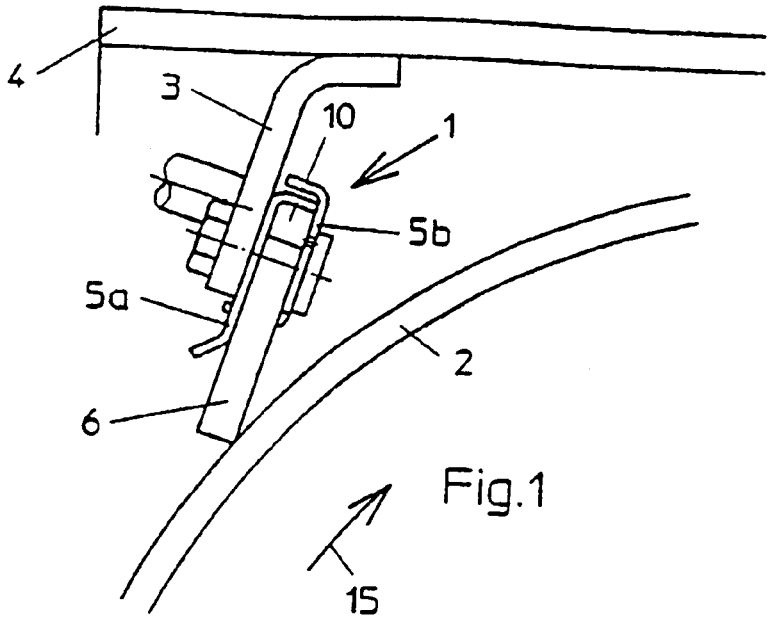
FIG. 1 shows the device mounted on the tire carrier and resting with its stripper against the tire, in side view as seen parallel to the tire axis.

The device 1 illustrated in the drawing serves for cleaning a tire 2 of a soil tamping roller, the tire being indicated merely diagrammatically in FIG. 1, of adhering dirt and for spraying the tire 2 with water.

Figure 3:
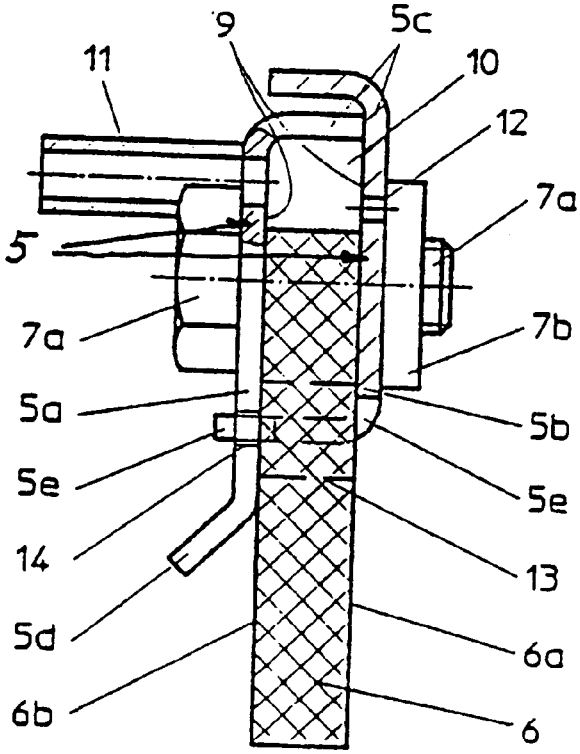
FIG. 3 shows a cross section through a device in a section along the sectional line III—III in FIG. 2.
Figure 2:
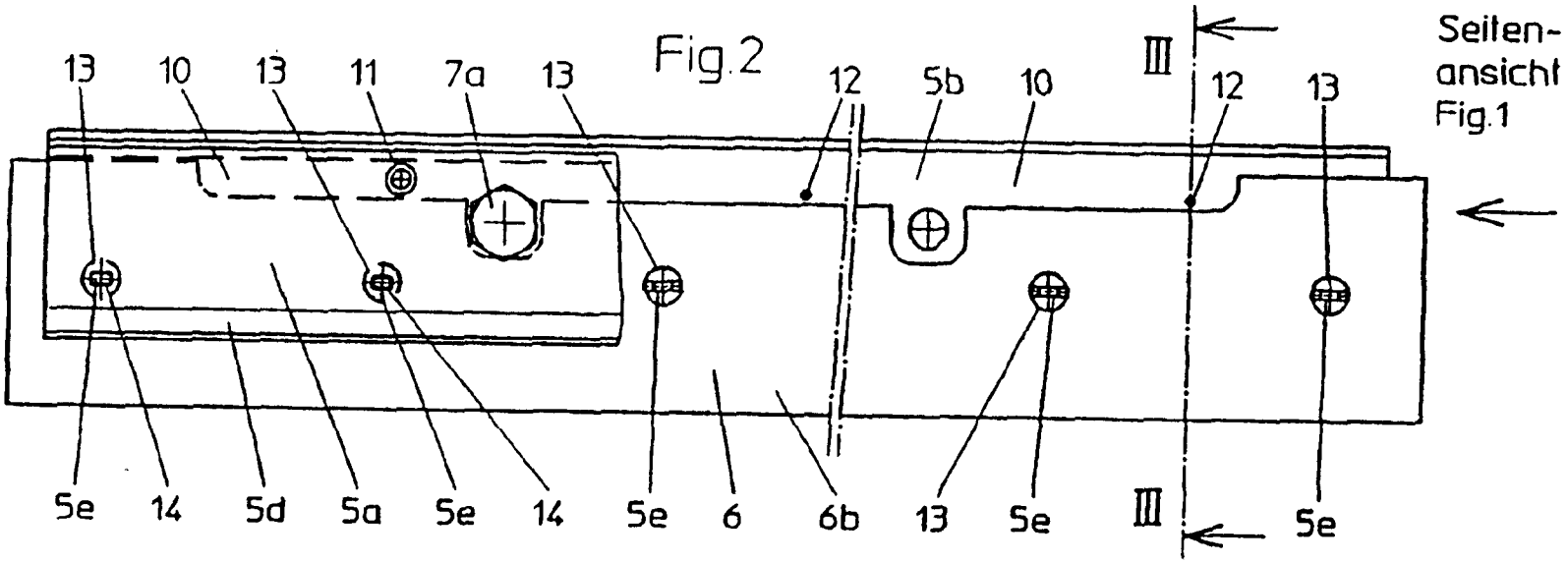
FIG. 2 shows the device in a front view, as seen from the left by the observer of FIG. 1, the connection piece between the device and the tire carrier not being illustrated for the sake of greater clarity.

The device 1 is fastened, in the oblique position in relation to the tire 2 evident from FIG. 1, to the tire carrier 4, likewise indicated merely diagrammatically in FIG. 1, by means of a connection element 3 which is not illustrated in FIG. 2 and FIG. 3 for the sake of clarity.

The device 1 has a stripping device and a nozzle arrangement which are combined to form a structural unit. This structural unit consists of a trough-like stripper holder 5, and a stripper 6. The stripper 6 is formed from two parts 5*a* and 5*b* and which extend continuously over the width of that region of the tire 2 to be cleaned. The stripper 6 is made of elastic plastic, is arranged in the stripper holder 5, and has wide sides 6*a*, 6*b* parallel to one another and, with its end regions located on its end faces and on the left and right for the observer of FIG. 2, fills the cross section of the stripper holder 5 in an essentially liquid-tight manner. The material of the stripper is preferably polyurethane.

As already mentioned, the stripper holder 5 consists of two parts 5*a* and 5*b* which can be closed together by means of screw bolts 7*a* and nuts 7*b*, extend in each case over the length of the stripper 6 and between them form a trough 9 for receiving the stripper 6 in a sealed-off manner. The trough 9 has an essentially rectangular U-shaped cross section.

As may best be seen from FIG. 2, the stripper 6 forms a cavity 10 which is sealed off relative to the stripper holder 5 and extends over a substantial part of the length of the stripper holder 5. A water inflow line 11 branches off into the cavity 10 through the wall of the stripper holder part 5*a*, and nozzles 12 branch off from the cavity 10 through the wall of the stripper holder part 5*b*. The edge of the stripper 6 that is positioned adjacent the tire 2 extends essentially perpendicularly to the direction of rotation of the tire 2 and essentially parallel to the surface of the tire 2 over the region to be cleaned. Nozzles 12, arranged at a distance from one another and approximately parallel to the stripper 6, are arranged in such a way that the water emerging from them passes onto the tire 2 behind the stripper 6 in the tire running direction.

The two parts 5*a*, 5*b* forming the stripper holder are each have bent at right angles to the other parts 5*a*, 5*b* along their longitudinal edges which are located at the top in the position of use. A bent leg 5*c* of the part 5*a* faces the stripper 6 and has a width corresponding essentially to the thickness of the stripper 6. The two parts 5*a*, 5*b* of the stripper holder are reinforced by the legs 5*c*. Part 5*a*is also at the lower end, by a further angled wall part 5*d*, so that the stripper 6 is retained securely in the desired oblique position relative to the tire 2, as is evident from FIG. 1.

As is clear from FIG. 2 and FIG. 3, the part 5*b* located on the right for the observer of FIG. 3 and at the rear for the observer of FIG. 2 terminates, at its lower end facing the tire 2, in tines 5*e*. Tines 5*e* are angled toward the stripper holder part 5*a*, and are distributed over the length of the part 5*b*, and pass through the passage holes 13 of the stripper 6 and through orifices 14 in the part 5*a* of the stripper holder 5. The orifices 14 have a smaller cross section than the passage holes. The tines 5*e* retain the stripper 6 immovably in the stripper holder 5 and, at the same time, ensure that the stripper parts 5*a*, 5*b* are in the desired predetermined position in relation to one another.

The connection of the two parts 5*a*, 5*b* of the stripper holder 5 under the stripper 6 by means of the screw bolts 7*a* and nuts 7*b* brings about secure releasable bracing of the stripper holder 5 against the stripper 6, so that no water can flow out of the cavity 10 along the wide sides 6*a*, 6*b* between the parts 5*a* and 5*b*, on the one hand, and the stripper 6, on the other hand.

As can be seen in FIG. 1, the stripper 6 is set preferably at an acute angle to the tire 2 counter to the running direction 13. A second device 1 is located, at an opposite set angle, on the other side of the upper vertex of the tire 2 and performs the stripping function there in the opposite running direction of the tire 2.

What is claimed is:

1. A device for cleaning a tire of a soil tamping roller of adhering dirt and for spraying the tire with water, comprising:

a) a stripping device which extends essentially perpendicularly from a direction of tire rotation over a region of the tire to be cleaned and which is fastened to a tire carrier in a fixed position in relation to the tire, and b) a nozzle arrangement which is fastened to the tire carrier in a fixed position in relation to the tire and which is provided with nozzles, the nozzles being arranged at a distance from one another and approximately parallel to the stripping device in the direction of tire rotation, wherein c) the stripping device and the nozzle arrangement are combined to form a structural unit, and d) the structural unit is formed from aa) a stripper holder which extends continuously over a width of the tire region to be cleaned, and bb) a stripper which is arranged in the stripper holder, and which projects over an entire length of the stripper holder out of the stripper holder, and toward the tire, e) the stripper has a cavity which is sealed off relative to the stripper holder which extends over a substantial part of the length of the stripper holder, into which a water inflow line opens, and from which the nozzle branch off through a wall of the stripper holder.

2. The device as claimed in claim 1, wherein a trough of the stripper holder that receives the stripper has an essentially U-shaped cross section.

3. The device as claimed in claim 1, wherein the stripper holder includes two parts which each extend over an entire length of the stripper which are capable of being closed together,and which cooperate to form a trough for receiving the stripper in a scaled-off manner.

4. The device as claimed in claim 3, wherein the two parts of the stripper holder are reinforced by angled wall parts extending over an entire length of the parts.

5. The device as claimed in claim 3, wherein at least one of the two parts of the stripper holder is bent at right angles toward the other part along a longitudinal edge thereof, and the bent part has a width corresponding essentially to a thickness of the stripper.

6. The device as claimed in claim 3, wherein the two parts of the stripper holder are braced releasably against the stripper.

7. The device as claimed in claim 1, wherein the stripper is formed from an elastic plastic, has sides that are parallel to one another, and fills a cross section of a trough of the stripper holder in an essentially liquid-tight manner.

8. The device as claimed in claim 7, wherein the elastic plastic consists of polyurethane.

9. The device as claimed in claim 7, wherein the cavity in the stripper is formed by an edge cutout in a region of the stripper which is located in the stripper holder.

10. The device as claimed in claim 1, wherein the stripper extends an acute angle to the tire counter to the direction of tire rotation.

11. In combination:

1) a tire for a soil tamping roller; and

2) a device for cleaning the tire of adhering dirt and for spraying the tire with water, the device comprising a) a stripping device which extends essentially perpendicularly from a direction of tire rotation over a region of the tire to be cleaned and which is fastened to a tire carrier in a fixed position in relation to the tire, and b) a nozzle arrangement which is fastened to the tire carrier in a fixed position in relation to the tire and which is provided with nozzles, the nozzles being arranged at a distance from one another and approximately parallel to the stripping device in the direction of tire rotation, wherein c) the stripping device and the nozzle arrangement are combined to form a structural unit, and d) the structural unit is formed from aa) a stripper holder which extends continuously over a width of the tire region to be cleaned, and bb) a stripper which is arranged in the stripper holder and which projects over an entire length of the stripper holder, out of the stripper holder, and toward the tire, e) the stripper has a cavity which is sealed off relative to the stripper holder which extends over a substantial part of the length of the stripper holder, into which a water inflow line opens, and from which the nozzles branch off through a wall of the stripper holder.

* * * * *